US006829845B2

(12) United States Patent
Han et al.

(10) Patent No.: US 6,829,845 B2
(45) Date of Patent: Dec. 14, 2004

(54) LAUNDRY DRIER

(75) Inventors: In Hee Han, Changwon-si (KR); Ju Han Yoon, Changwon-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/730,279

(22) Filed: Dec. 9, 2003

(65) Prior Publication Data

US 2004/0163276 A1 Aug. 26, 2004

(30) Foreign Application Priority Data

Dec. 10, 2002 (KR) ..... 10-P2002-0078288

(51) Int. Cl.[7] ..... F26B 11/02
(52) U.S. Cl. ..... 34/603
(58) Field of Search ..... 34/603, 595, 602, 34/202, 596, 607, 601, 604; 68/5 E, 3 R, 298

(56) References Cited

U.S. PATENT DOCUMENTS 2,728,481 A * 12/1955 Robinson et al. ..... 220/4.02
5,881,576 A * 3/1999 Davies, Jr. ..... 68/3 R
6,006,445 A * 12/1999 Large ..... 34/609

FOREIGN PATENT DOCUMENTS

GB 2253035 A * 8/1992 ..... D06F/58/04

* cited by examiner

*Primary Examiner*—Kenneth Rinehart
(74) *Attorney, Agent, or Firm*—Fleshner & Kim, LLP

(57) ABSTRACT

An apparatus for preventing a gap between a blower housing and a connection duct is provided in laundry drier including a base forming a bottom of a body, a front cabinet forming a front side of the body, a pair of opposing lateral cabinet sides, a back cover forming a rear side of the body, a top cover installed on an upper part of the body, a filter cover installed in rear of the front cabinet, a connection duct having an entrance side connected to the filter cover, and a blower installed to be connected to an exit side of the connection duct, which blocks an ancillary air flow to prevent a degradation in drying efficiency and drier performance. The apparatus includes a pressing member provided between the front cabinet and the connection duct to push the connection duct toward the blower to make the connection duct adhere closely to the blower housing.

7 Claims, 3 Drawing Sheets

LAUNDRY DRIER

This application claims the benefit of Korean Application No. 10-2002-0078288 filed on Dec. 10, 2002, which is hereby incorporated by reference.

BACKGROUND OF THE INVENTION

1. Field of the Invention

The present invention relates to a laundry drier, and more particularly, to laundry drier having an apparatus for preventing a gap between a blower housing and connection duct of a blower assembly.

2. Discussion of the Related Art

Generally speaking, a laundry drier is an apparatus for drying wet objects, e.g., clothes, after completion of a washing cycle or the like. A general laundry drier is shown in FIG. 1, while a blower assembly of such a laundry drier is illustrated in FIG. 2.

Referring to FIGS. 1 and 2, a laundry drier body B is comprised of a base 1 forming a bottom, a front cabinet 2 forming a front side, a pair of opposing lateral cabinet sides 3, a back cover 4 forming a rear side, a top cover 5 installed on an upper part of the laundry drier body B, and a control panel 6 on a rear end of the top cover 5. A laundry drier typically includes an entrance in the front cabinet 2 constructing the body B for accessing the laundry, and a door 10 corresponding to the entrance is installed at the front cabinet 2. A drum (not shown) is rotatably installed within the body B to rotate by receiving a driving force of a motor (not shown). Communicating with the interior of the drum are separate passages (not shown) for respectively supplying and discharging hot air, and a heater (not shown) for heating air flowing from an external environment of the laundry drier is mounted in the hot air supply passage. A blower 7 housed in a blower housing 7*a* is installed in the hot air discharge passage to generate a blowing force for forcibly guiding the heated air into the drum for a drying step and for expelling the used air from the body B. A filter cover 8 having an air intake opening 800 and a connection duct 9 connected to the filter cover 8 are provided in the hot air discharge passage between the drum and the blower 7. A lint filter 11 is loaded inside the connection duct 9.

In the operation of the above-constituted laundry drier according to the related art, with an object to be dried placed in the drum, a drying step is executed whereby the heater and motor are actuated. As an exhaust fan starts operating, external air having been led into the body B via an intake side of the hot air supply passage passes through the heater to be heated to generate hot air. The hot air is then forcibly led into the drum via the hot air supply passage. The hot air in the drum evaporates the water content of the object to be dried, using a negative blowing force of the discharge fan to be discharged outside the body B, and such a circulation is repeated. Specifically, the air in the drum flows via the air intake opening 800 formed in the filter cover 8 to pass through the lint filter 11 and then flows in the blower 7, while the drum rotates at low speed by receiving the driving force of the motor via a belt. Accordingly, a wet object is dried.

In the related art laundry drier, however, vibration and the like, which are inherently generated while the laundry drier operates and during normal usage, creates a gap (separation) between a blower housing 7*a* of the blower 7 and the connection duct 9. The gap allows an ancillary air flow, as represented by the arrows of FIG. 2, which degrades a blowing efficiency of the blower 7 and in turn reduces drying efficiency and impedes drier performance.

SUMMARY OF THE INVENTION

Accordingly, the present invention is directed to a laundry drier that substantially obviates one or more of the problems due to limitations and disadvantages of the related art.

An object of the present invention, which has been devised to solve the foregoing problem, lies in providing a laundry drier having an apparatus for preventing a gap between a blower housing and a connection duct, which blocks an ancillary air flow to prevent a degradation in drying efficiency and drier performance.

Additional features and advantages of the invention will be set forth in the description which follows, and in part will be apparent to those having ordinary skill in the art upon examination of the following or may be learned from a practice of the invention. The objectives and other advantages of the invention will be realized and attained by the subject matter particularly pointed out in the specification and claims hereof as well as in the appended drawings.

To achieve these objects and other advantages in accordance with the present invention, as embodied and broadly described herein, there is provided an apparatus for preventing a gap between a blower housing and a connection duct in a laundry drier including a base forming a bottom of a body, a front cabinet forming a front side of the body, a pair of opposing lateral cabinet sides, a back cover forming a rear side of the body, a top cover installed on an upper part of the body, a filter cover installed in rear of the front cabinet, a connection duct having an entrance side connected to the filter cover, and a blower installed to be connected to an exit side of the connection duct. The apparatus comprises a pressing member provided between the front cabinet and the connection duct to push the connection duct toward the blower to make the connection duct adhere closely to the blower housing.

It is to be understood that both the foregoing explanation and the following detailed description of the present invention are exemplary and illustrative and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENTS

Reference will now be made in detail to the preferred embodiments of the present invention, examples of which are illustrated in the accompanying drawings. Throughout the drawings, like elements are indicated using the same or similar reference designations where possible.

Figure 1:
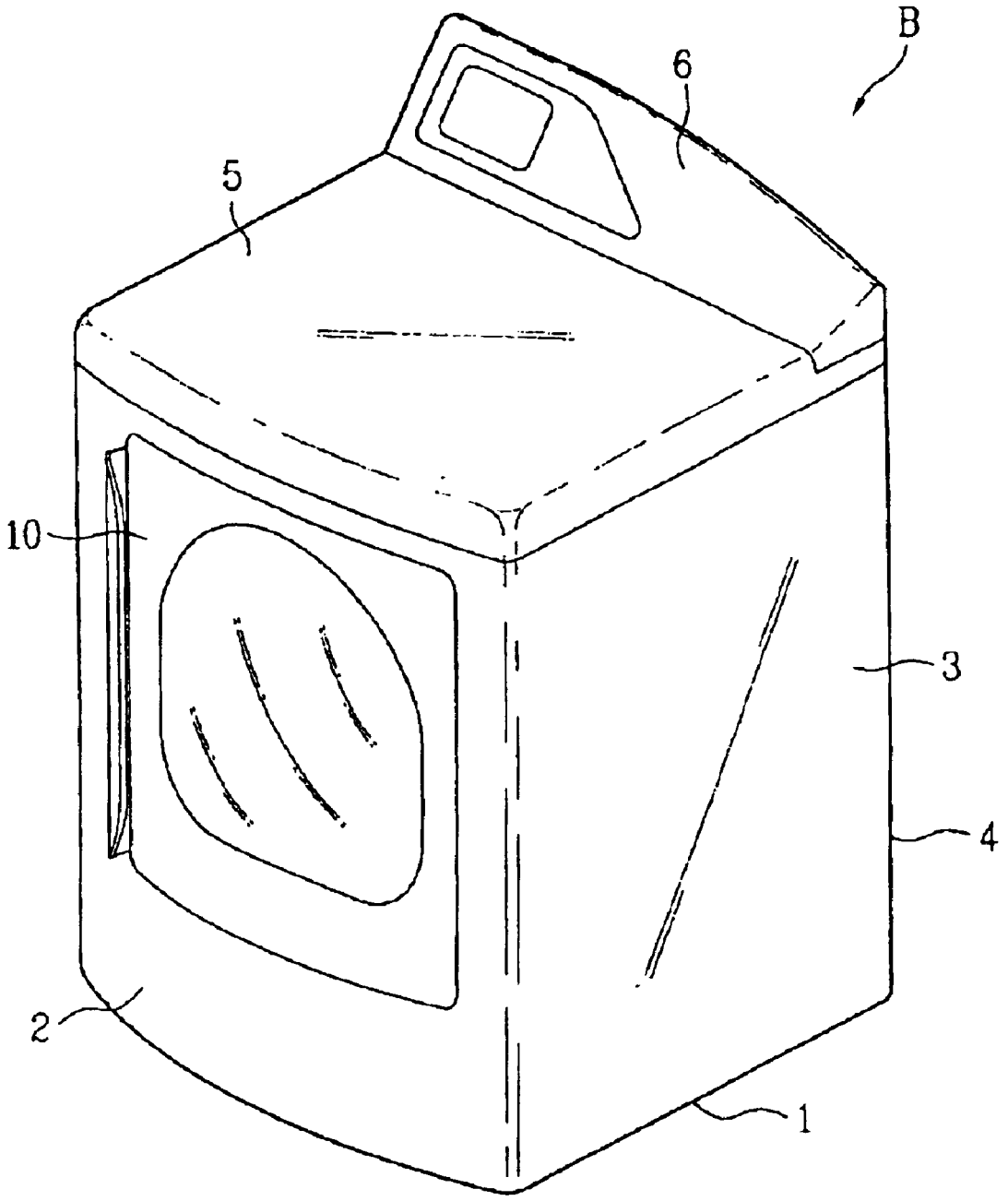
FIG. 1 Related Art
FIG. 1 is a perspective view of an exterior of a general laundry drier.
Figure 2:
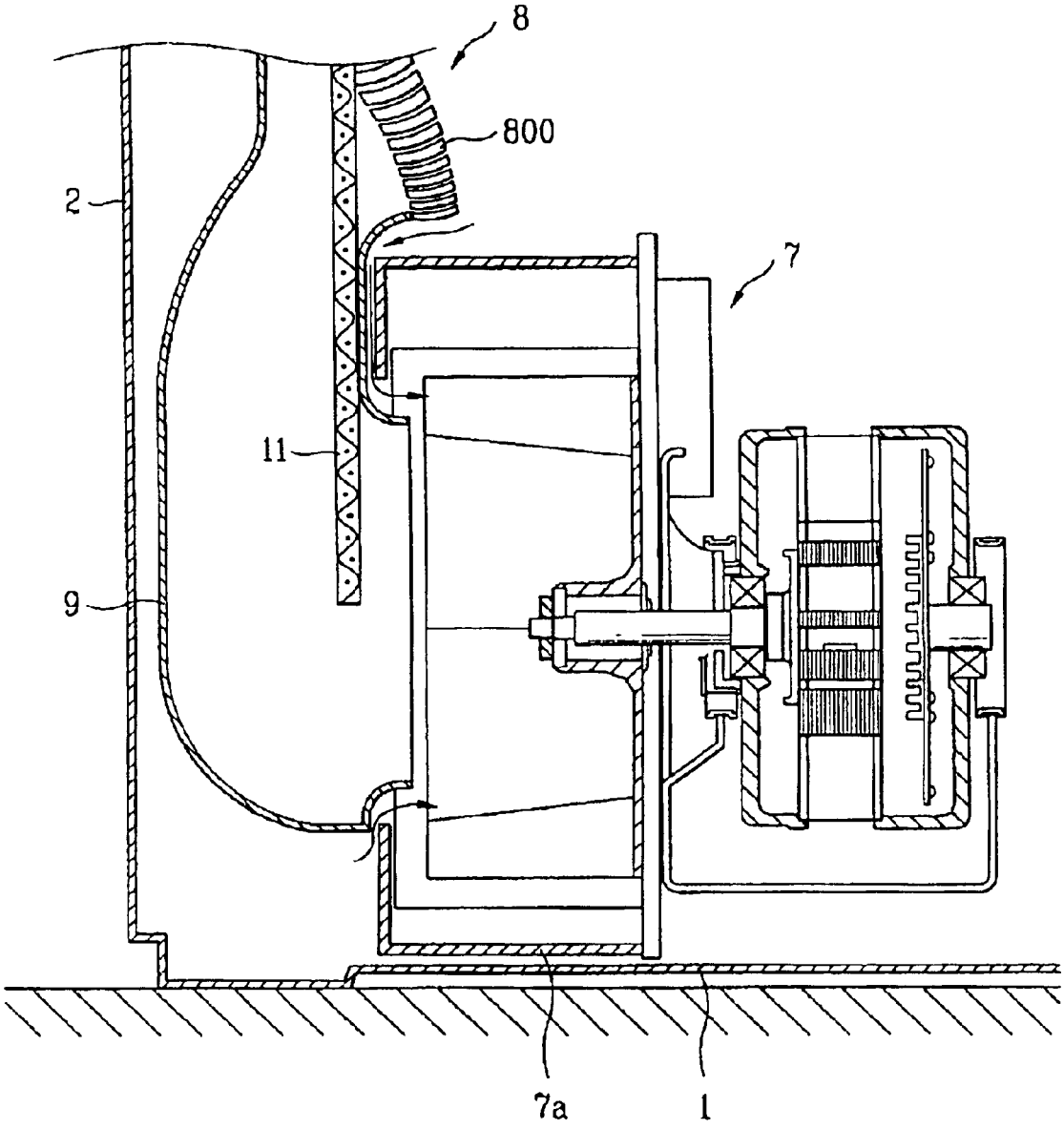
FIG. 2 Related Art
FIG. 2 is a cross-sectional view of a laundry drier according to a related art.
Figure 3:
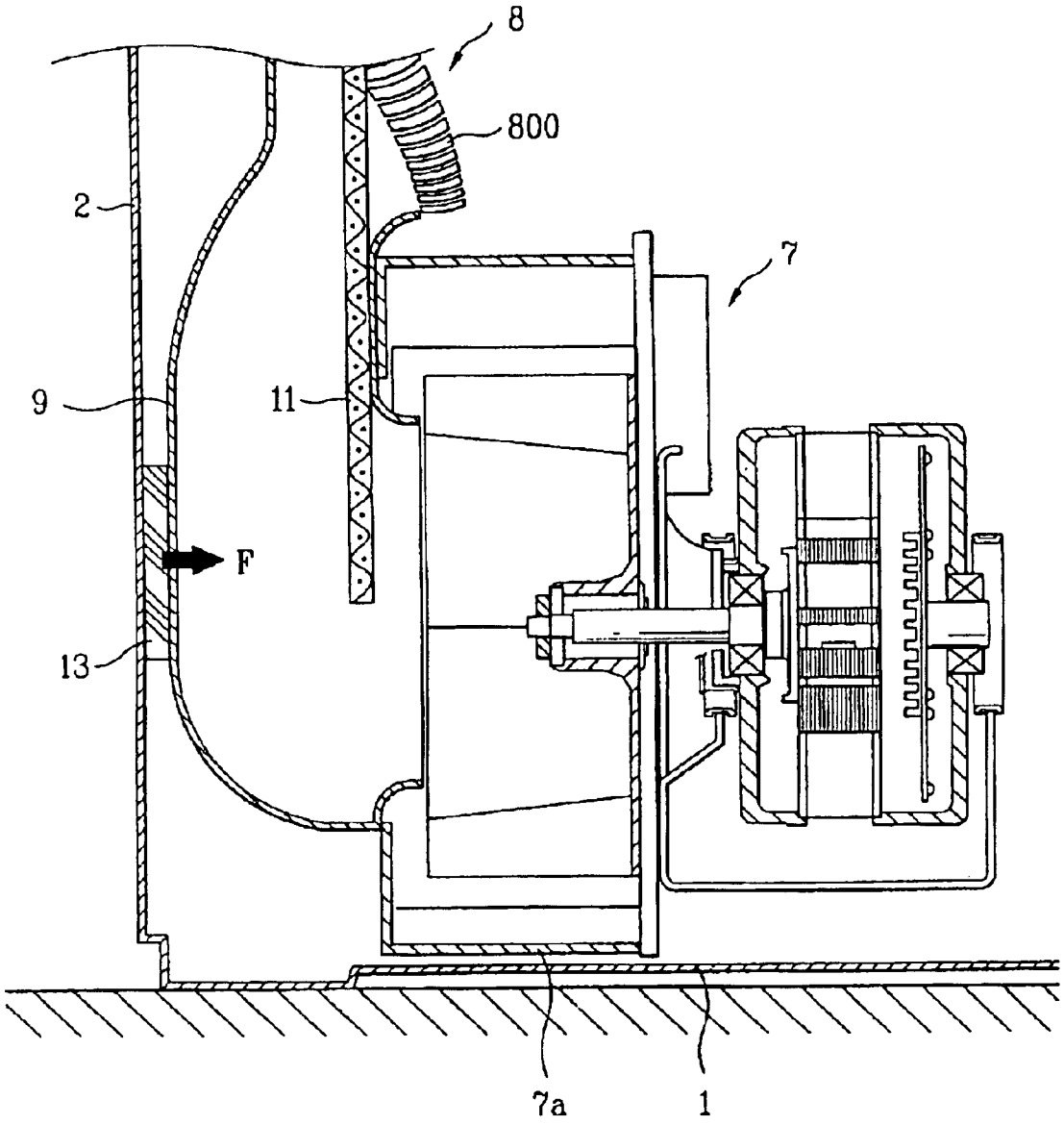
FIG. 3 is a cross-sectional view of a laundry drier according to the present invention.

FIG. 3 illustrates a laundry drier according to the present invention.

A laundry drier according to the present invention comprises a base 1 forming a bottom of a body B, a front cabinet 2 forming a front side of the body B, a pair of opposing lateral cabinet sides 3, a back cover 4 forming a rear side of the body B, a top cover 5 installed on an upper part of the laundry drier body B, a filter cover 8 installed in rear of the front cabinet 2, a connection duct 9 having an entrance side connected to the filter cover 8, a blower 7 installed to be connected to an exit side of the connection duct 9, and an apparatus for preventing a gap between a blower housing 7*a* and the connection duct 9. The apparatus of the present invention includes a pressing member 13 provided between the front cabinet 2 and the connection duct 9 to push the connection duct 9 toward the blower 7 to make the connection duct 9 adhere closely to the blower housing 7*a*.

The pressing member 13 is preferably formed of an elastic body giving a pushing force F, attributed to an elastic restoration force of the elastic body itself, to the connection duct 9 when receiving elasticity to be compressed between the front cabinet 2 and the connection duct 9. For instance, the elastic body may be made of a rubber. As an alternative to the elastic body, the pressing member 13 may be embodied as an elastic member such as a coil spring or a plate spring having a form giving the elasticity.

According to another embodiment, the pressing member 13 may be formed of a non-elastic body having a thickness slightly greater than an interval between the front cabinet 2 and the connection duct 9 when the connection duct 9 is brought into tight contact with the blower housing 7*a*.

The pressing member 13 may be attached to either the front cabinet 2 or the connection duct 9. Attachment to the front cabinet 2 is preferable if the pressing member 13 is an elastic body, and attachment to the connection duct 9 is preferable if the pressing member 13 is a non-elastic body.

In the operation of the above-constructed laundry drier according to the present invention, air inside the drum flows through the air intake opening 800 of the filter cover 8 to pass through the lint filter 11 and then flows in the blower 7 along the connection duct 9. The pressing member 13, installed between the front cabinet 2 and the connection duct 9 to push the connection duct 9 toward the blower 7, closes a gap between the connection duct 9 and the blower housing 7*a* of the blower 7.

The laundry drier according to the present invention employs the pressing member 13, which is formed of an elastic body giving a pushing force attributed to an elastic restoration force to the connection duct 9 when receiving elasticity to be compressed between the front cabinet 2 and the connection duct 9, or of a non-elastic body having a thickness greater than an interval between the front cabinet 2 and the connection duct 9 when the connection duct 9 is brought tight contact with the blower housing 7*a*, whereby the connection duct 9 always adheres closely to the blower housing 7*a* of the blower 7 to prevent the creation of a gap resulting from vibrations generated while the laundry drier operates and during normal usage. Thus, an ancillary air intake through such a gap, which flows toward the blower 7 through the gap from elsewhere in the laundry drier instead of from the drum, is cut off to enhance drying efficiency and drier performance.

It will be apparent to those skilled in the art that various modifications and variations can be made in the present invention without departing from the spirit or scope of the invention. Thus, it is intended that the present invention cover such modifications and variations, provided they come within the scope of the appended claims and their equivalents.

What is claimed is:

1. In a laundry drier including a base forming a bottom of a body, a front cabinet forming a front side of the body, a pair of opposing lateral cabinet sides, a back cover forming a rear side of the body, a top cover installed on an upper part of the body, a filter cover installed in rear of the front cabinet, a connection duct having an entrance side connected to the filter cover, and a blower installed to be connected to an exit side of the connection duct, an apparatus for preventing a gap between a blower housing of the blower and the connection duct comprising a pressing member provided between the front cabinet and the connection duct to push the connection duct toward the blower to make the connection duct adhere closely to the blower housing.

2. The apparatus as claimed in claim 1, wherein the pressing member is formed of an elastic body giving a pushing force attributed to an elastic restoration force to the connection duct when receiving elasticity to be compressed between the front cabinet and the connection duct.

3. The apparatus as claimed in claim 2, wherein the elastic body is a rubber.

4. The apparatus as claimed in claim 1, wherein the pressing member is an elastic member selected from the group consisting of a coil spring and a plate spring.

5. The apparatus as claimed in claim 1, wherein the pressing member is a non-elastic body having a thickness greater than an interval between the front cabinet and the connection duct when the connection duct is brought tight contact with the blower housing.

6. The apparatus as claimed in claim 1, wherein the pressing member is attached to the front cabinet.

7. The apparatus as claimed in claim 1, wherein the pressing member is attached to the connection duct.

* * * * *